United States Patent [19]

Ellul, Jr.

[11] Patent Number: 4,826,163

[45] Date of Patent: May 2, 1989

[54] BILLIARD CUE CHALK HOLDER

[76] Inventor: Joseph Ellul, Jr., P.O. Box 46218, Mt. Clemens, Mich. 48046

[21] Appl. No.: 182,145

[22] Filed: Apr. 15, 1988

[51] Int. Cl.[4] ..... A63D 15/16

[52] U.S. Cl. ..... 273/21

[58] Field of Search ..... 273/17, 18, 19, 20, 273/21, 14

[56] References Cited

U.S. PATENT DOCUMENTS

| | | | |
|---|---|---|---|
| 334,099 | 1/1886 | Zaehringer | 273/21 |
| 789,779 | 5/1905 | Wright | 273/20 |
| 974,066 | 10/1910 | Jay | 273/19 |
| 1,016,953 | 2/1912 | Peloquin | 273/21 |
| 1,031,668 | 7/1912 | Vasbinder | 273/17 |
| 1,194,212 | 8/1916 | Moore | 273/21 |
| 1,450,741 | 4/1923 | Hill | 273/21 |
| 1,571,211 | 2/1926 | Nelson | 273/17 |
| 1,627,573 | 5/1927 | Peterson | 273/19 |
| 4,151,991 | 5/1979 | Smith, Jr. | 273/21 |

FOREIGN PATENT DOCUMENTS

| | | | |
|---|---|---|---|
| 802962 | 9/1936 | France | 273/17 |

*Primary Examiner*—Richard C. Pinkham
*Assistant Examiner*—T. Brown
*Attorney, Agent, or Firm*—Basile & Hanlon

[57] ABSTRACT

A billiard cue chalk holder having a housing with side walls, opposed end walls and a hollow internal cavity having a cross section configured to stationarily receive a cubical billiard cue chalk block. An aperture is formed in at least one of the end walls and disposed in communication with the cavity in the housing to allow insertion of the tip of a billiard cue stick therethrough into contact with the chalk block housed internally within the housing. Mounting flanges formed on the housing receive fasteners to stationarily mount the housing on a flat surface, such as the side of a billiard table. The length of the cavity is configured to receive one or more cubical billiard cue chalk blocks, all of which are accessible for applying chalk to the tip of a billiard cue stick through the apertures formed in one or both of the end walls of the housing.

9 Claims, 1 Drawing Sheet

BILLIARD CUE CHALK HOLDER

BACKGROUND OF THE INVENTION

1. Field of the Invention:

The present invention relates, in general, to article holders and, more specifically, to billiard cue chalk holders.

2. Description of the Prior Art:

While playing the games of pool and billiards, players frequently apply chalk to the tip of the cue stick in order to increase the frictional contact between the tip of the cue stick and the cue ball and to prevent slippage therebetween. Over the years, the fabrication of the chalk has been standardized to the form of a small cube or block, three-quarters of an inch on a side. Paper or cardboard is wrapped around all but one side of the chalk block. A hemispherical depression is formed in the uncovered end of the chalk block to receive the tip of a cue stick.

The small size of the chalk blocks cause numerous problems in their use. For one, the chalk blocks are easily lost or misplaced thereby delaying the play of the game or diminishing its enjoyment since the level of skill of the players decreases without the use of chalk. Further, the chalk blocks are frequently dropped or knocked into the pockets of the billiard table causing jamming of the ball return tracks which prevents collection of the balls in the ball collection box or trough. Also, the chalk blocks usually break when dropped onto the floor thereby rendering them useless. Finally, theft of chalk blocks, either intentionally or accidentally, poses a major concern for the operators of commercial pool or billiards establishments.

To overcome these problems, numerous devices or holders have been created to hold the chalk blocks in a readily accessible yet non-removable location on or near a pool or billiard table. The holders include a housing holding the chalk block. An aperture is formed in the housing and allows the cue tip to be inserted into the interior of the housing into contact with the chalk block to apply chalk thereto by manual rotation of the cue stick or automatically by rotational means mounted in the housing and coupled to the chalk block.

However, such chalk holders are not without certain limitations. Such chalk holders are designed to hold one and at most two chalk blocks in a stationary position with respect to a billiard or pool table. While minimizing loss or misplacement of the chalk blocks, the minimal number of chalk blocks contained in each housing necessitates frequent replacement of the chalk blocks which is a time consuming task, especially in large pool and billiard establishments.

What is still needed, despite the numerous attempts to provide an effective billiard cue chalk holder, is a billiard cue chalk holder which prevents loss or theft of chalk blocks, eliminates the possibility of droppage onto the floor or into the pockets of the billiard table and, at the same time, is convenient to use. It would be desirable to provide a billiard cue chalk holder which minimizes the need for frequent replacement of the chalk blocks mounted in the holder. It would also be desirable to provide a billiard cue chalk holder which is easily usable to apply chalk to the tip of cue sticks.

SUMMARY OF THE INVENTION

The present invention is a billiard cue chalk holder which is capable of holding one or more chalk blocks in a readily accessible position for applying chalk to the tip of a billiard cue stick.

The billiard cue chalk holder has a housing formed of side walls, first and second opposed end walls and a hollow internal cavity. The hollow internal cavity has a cross section configured to stationarily receive a cubical billiard cue chalk block and, in one embodiment, a plurality of chalk blocks in a co-axial arrangement. One of the side walls of the housing is open allowing access to the interior of the housing for inserting or removing chalk blocks therefrom.

An aperture is formed in one of the end walls of the housing and is disposed in communication with the cavity in the housing to allow the insertion of the tip of a cue stick therethrough into contact with the chalk blocks housed internally within the cavity in the housing. In a preferred embodiment, an aperture is formed on each of the opposed end walls thereby allowing access to the chalk blocks housed within the housing from either end of the housing.

Mounting means are provided for fixedly mounting the housing to a flat surface, such as the side of a billiard table, a wall, etc. In a preferred embodiment, the mounting means comprises at least one and preferably two flanges integrally formed with the housing and extending outward from the side walls of the housing. In one embodiment, the flanges are disposed adjacent to the open portion of the side wall of the housing. Apertures formed in each flange receive suitable fasteners, such as screws, etc., for removably mounting the housing to a flat surface.

When the housing containing one or more chalk blocks is mounted to a flat surface, the open portion of the side wall of the housing is covered by the flat surface thereby preventing access to the interior of the housing and prohibiting unauthorized removal of the chalk blocks therefrom. Access to the interior of the housing for applying chalk to the tip of a cue stick is, however, easily provided through the apertures in the end walls.

The unique billiard cue chalk holder of the present invention overcomes many of the deficiencies encountered with previously devised attempts to provide a stationarily mountable billiard cue chalk holder. By making the holder attachable to a flat surface, such as the side of a billiard table, loss or theft of the chalk blocks is eliminated. Further, droppage of the chalk blocks into the pockets of a billiard table or onto the floor is also eliminated. Both of these advantages tremendously increase the useful life of each chalk block thereby minimizing cost to the operators of billiard or pool establishments.

The length of the housing and the internal cavity extending between the opposed end walls may also be designed in any length to house any number of chalk blocks in a coaxial arrangement. This reduces the time involved in replacing used chalk blocks in previously devised holders which contain one and at most two chalk blocks.

Finally, the billiard cue chalk holder of the present invention is easily mountable in a readily accessible position which makes it easy for players to utilize the holder in applying chalk to the tip of billiard cue sticks.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
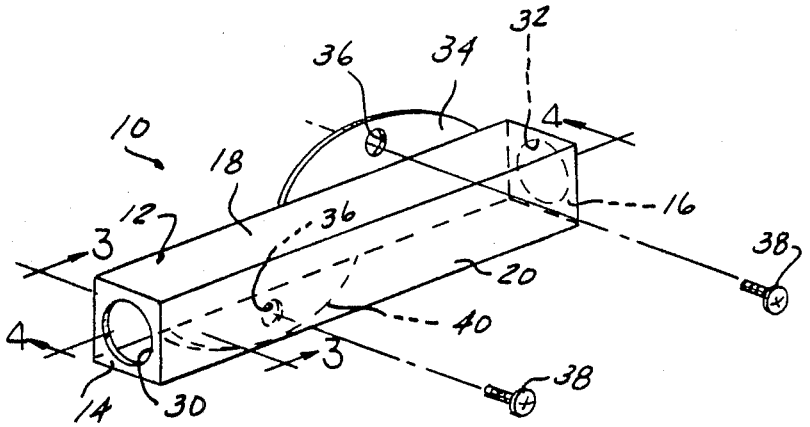
FIG. 1 is a perspective view of the billiard cue chalk holder constructed in accordance with one embodiment of the present invention.

Throughout the following description and drawing, an identical reference number is used to refer to the same component shown in multiple figures of the drawing.

Referring now to the drawing, and to FIG. 1 in particular, there is illustrated a billiard cue chalk holder 10 which is useful in storing and allowing the non-removable use of one or more billiard cue chalk blocks and which can be stationarily mounted on a flat surface, such as the sides of a billiard or pool table.

Figure 2:
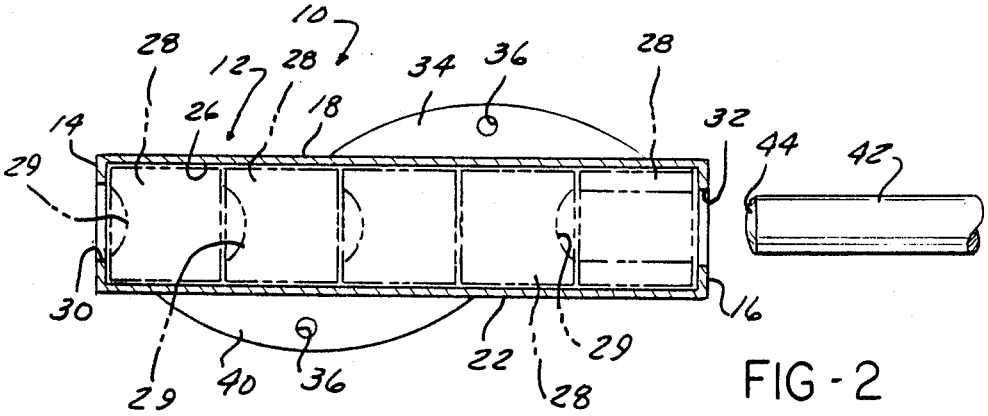
FIG. 2 is a cross sectional view generally taken along line 2—2 in FIG. 1.
Figure 3:
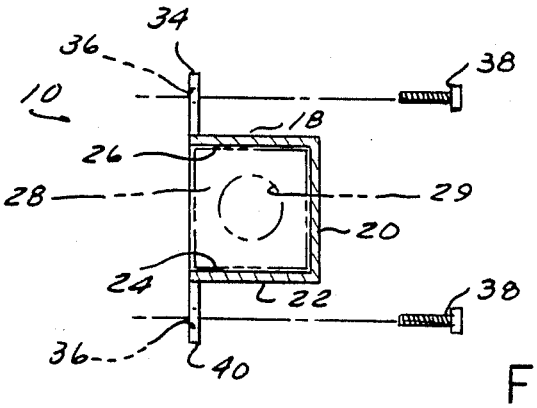
FIG. 3 is a cross sectional view generally taken along line 3—3 in FIG. 1.

As shown in FIGS. 1, 2 and 3, the billiard cue chalk holder 10 of the present invention includes a housing 12 which is formed of any suitable material, such as plastic, metal, etc. The housing 12 generally has a shape to receive one or more cubical billiard cue chalk blocks, as described hereafter. Thus, while the housing 12 is illustrated as having a square cross section, it is only necessary that the internal cross section of the housing be sized to stationarily receive a standard cubical billiard cue chalk block. Thus, the housing may have any desired outside shape, such as square, triangular, circular, etc.

The housing 12 is formed with first and second opposed end walls 14 and 16 and a side wall 18. Due to the square cross section of the housing 12 shown in FIGS. 1, 2 and 3, the side wall is formed of four portions, namely, solid side walls 18, 20 and 22 and open side 24. As shown in FIG. 3, side wall 24 which is disposed in registry with a flat surface to which the housing 12 is mounted, as described hereafter, is open. The open side wall 24 allows access to the interior of the housing 12 for the insertion or removal of chalk blocks therefrom.

A hollow internal cavity 26 is formed within the housing 12 and extends longitudinally between the end walls 14 and 16. The cavity 26, as shown in FIGS. 2 and 3, has a substantially square cross section and is sized to snugly receive a cubical, standard chalk block 28. It should be noted that the length of the housing 12 and the length of the internal cavity 26 may be provided in any desired dimension so as to stationarily house one or more standard sized cubical chalk blocks 28. Such standard chalk blocks 28 are generally provided in a cube, three-quarters of an inch on a side. Thus, in the embodiments shown in FIGS. 1 and 2, the housing 12 has an overall length for receiving five standard sized, individual chalk blocks 28. The length may be varied as necessary to house more or less chalk blocks as desired. It should also be noted that the length of the housing 12 and the internal cavity 26 may also be sized in any dimension to receive a single, non-standard sized chalk block having a length greater than the length of a standard single chalk block. The overall length of the non-standard chalk block may be equivalent to two, three, four, etc. individual standard sized chalk blocks arranged end to end.

First and second apertures 30 and 32, respectively, are formed in the end walls 14 and 16, respectively. The apertures 30 and 32 have a circular cross section and communicate with the cavity 26 in the interior of the housing 12. The apertures 30 and 32 function to allow access of a tip 44 of a standard pool or billiard cue stick 42, FIG. 2, therethrough into contact with the chalk blocks 28 housed in the internal cavity 26 in the housing 12, as described in greater detail below.

Mounting means is provided on the housing 12 for fixedly mounting the housing 12 to a flat surface, such as the side of a billiard or pool table, a wall, etc. In a preferred embodiment, the mounting means comprises at least one planar flange 34 which is mounted on the housing 12 and extends outward from one of the side walls, such as side wall 18 as shown in FIG. 3. An aperture 36 is formed in the flange 34 and receives a suitable fastener 38, such as a screw, for fixedly mounting the housing 12 to a flat surface.

In another embodiment, a pair of longitudinally spaced flanges 34 and 40 are formed on the housing 12 and extend outward from the side walls 18 and 22, respectively, of the housing 12. Both flanges 34 and 40 are provided with apertures 36 for receiving fasteners 38 to mount the housing 12 to a flat surface.

In using the billiard cue chalk holder 10 of the present invention, the desired number of chalk blocks 28 are first inserted into the interior cavity 26 in the housing 12 completely filling the internal cavity 26. The chalk blocks 28 are arranged with their hemispherical shaped end depressions 29 facing outward toward one of the apertures 30 and 32 as shown in FIG. 2. Certain of the depressions 29 are arranged in end to end relationship facing the aperture 30; while the remaining depressions 29 in the blocks 28 face the opposite aperture 32 in the end wall 16.

The housing 12 is then mounted to a flat surface, such as the side of a billiard or pool table, by inserting the fasteners 38 through the apertures 36 in the flanges 34 and 40. Preferably, the housing 12 is oriented in a substantially horizontally extending position to allow easy access to either end of the housing 12. As shown in FIG. 2, the tip 44 of a cue stick 42 may be inserted through one of the apertures 30 or 32 in the end walls 14 and 16, respectively, of the housing 12 into contact with the outer endmost chalk block 28 to apply chalk to the tip 44 when the cue stick 42 is manually rotated about its lengthwise extending axis. As the outermost chalk blocks 28 are used up, a bore is gradually formed therethrough, as shown in FIG. 2, until the outermost chalk block 28 is completely used up. Due to the stacked co-axial arrangement of the chalk blocks 28 in the internal cavity 26 of the housing 12, the continued application of chalk to the cue tip 44 may be achieved since chalk is readily available from the next innermost positioned chalk block. This alleviates the necessity of immediately replacing used chalk blocks in the chalk holder 10.

Thus, in one embodiment as shown in FIGS. 1 and 2, the billiard cue chalk holder 10 of the present invention includes a housing 12, first and second apertures 30 and 32 formed in opposed end walls 14 and 16, respectively, and at least one chalk block 28 housed in an internal cavity 26 in the housing 12. Mounting means in the form of at least one flange 34 integrally formed on the housing 12 is provided for stationarily fixing the housing 12 to a flat surface, such as the side of a billiard or pool table. In another embodiment, an aperture is formed in one of the end walls of the housing 12 to allow access to an end to end co-axial arrangement of a plurality of chalk blocks housed internally in the cavity 26 within the interior of the housing 12. Mounting flanges are again provided for stationarily fixing the housing 12 to a flat surface. In both embodiments, when the housing 12 is mounted to the flat surface, as shown in FIG. 3, the open side 24 of the housing 12 is disposed in registry with and covered by the flat surface thereby preventing access to the interior of the housing 12 and unauthorized removal of the chalk blocks 28 therefrom.

In summary, there has been disclosed a unique billiard cue chalk holder which provides all of the advantages of previously constructed chalk holders and, also, overcomes many of the deficiencies of such previously devised chalk holders. Since the housing of the present billiard cue chalk holder is stationarily mountable to a flat surface, such as the side of a billiard or pool table, access to the interior of the housing is prevented thereby eliminating any possibility of theft or loss of the chalk blocks housed within the interior of the housing. This also prevents any droppage of the chalk blocks onto the floor or their inadvertent droppage into the pockets of a billiard table.

Arranging a plurality of co-axially arranged, standard, cubical, chalk blocks within the interior of the elongated housing minimizes the time required to replace used chalk blocks since additional chalk blocks are readily usable after the outer endmost chalk blocks have been completely used up. The construction of the billiard cue chalk holder of the present invention also enables easy access to either end of the housing thereby simplifying the application of chalk to the tip of a cue stick.

What is claimed is:

1. A billiard cue chalk holder comprising:

a housing having a side wall, an aperture formed in the side wall, first and second opposed end walls and a hollow internal cavity, the internal cavity having a cross section configured to stationarily receive a cubical billiard cue chalk block insertable through the aperture in the side wall into the internal cavity;

first and second apertures formed in the first and second end walls, respectively, of the housing and disposed in communication with the internal cavity in the housing to allow a billiard cue tip to be inserted therethrough into contact with a billiard cue chalk blobk disposed within the internal cavity in the housing; and means, formed on the housing, for fixedly mounting the housing to a surface such that the aperture in the side wall is covered by the surface.

2. The billiard cue chalk holder of claim 1 wherein the cavity in the housing is configured to stationarily receive a plurality of co-axially, end-to-end aligned, cubical, billiard cue chalk blocks.

3. The billiard cue chalk holder of claim 1 wherein the mounting means comprises:

at least one flange formed integrally on the side wall of the housing and extending outward therefrom, an aperture formed in the flange to receive fastener means for stationarily mounting the housing on a surface.

4. The billiard cue chalk holder of claim 1 wherein the mounting means comprises:

two flanges formed integrally on the side wall of the housing, an aperture formed in each flange to receive fastener means for stationarily mounting the housing to a surface.

5. The billiard cue chalk holder of claim 1 wherein the housing has a square cross section formed by a plurality of side walls.

6. A billiard cue chalk holder comprising:

a housing having a plurality of contiguous side walls, an aperture formed between the side walls and first and second opposed end walls;

a hollow cavity formed internally within the housing and extending between the first and second opposed end walls, the cavity having a square cross section for stationarily receiving a cubical billiard cue chalk block insertable through the aperture in the side wall into the cavity;

first and second aperture means formed in the first and second end walls, respectively, of the housing and disposed in communication with the internal cavity in the housing for allowing a billiard cue tip to be inserted therethrough into contact with a billiard cue chalk block disposed within the internal cavity in the housing; and first and second flanges formed integrally with the side walls of the housing and extending outward therefrom, apertures being formed in the flanges for receiving fastening means therethrough to mount the housing on a surface such that the aperture in the side wall is covered by the surface.

7. The billiard cue chalk holder of claim 6 wherein the first and second flanges are disposed adjacent to the aperture in the side wall in the housing to dispose the aperture in the side wall in the housing in registry with a mounting surface when the housing is mounted on the mounting surface to close the aperture in the side wall in the housing.

8. The billiard cue chalk holder of claim 6 wherein the cavity has a length to receive a plurality of co-axially aligned cubical billiard cue chalk blocks.

9. A billiard cue chalk holder comprising:

a housing having a side wall, an aperture formed in the side wall, first and second opposed end walls and a hollow internal cavity extending between the first and second opposed end walls, the cavity having a cross section and length to stationarily receive a plurality of co-axially aligned cubical billiard cue chalk blocks insertable through the aperture in the side wall into the cavity;

aperture means formed in one of the first and second end walls of the housing and disposed in communication with the cavity in the housing for allowing a billiard cue tip to be inserted therethrough into contact with the billiard cue chalk blocks disposed within the cavity in the housing; and means, formed on the housing, for fixedly mounting the housing on a surface such that the aperture in the side wall is covered by the surface.

* * * * *